US007523779B2

(12) United States Patent
Kowalski

(10) Patent No.: US 7,523,779 B2
(45) Date of Patent: Apr. 28, 2009

(54) METHOD AND APPARATUS FOR PROVIDING DECORATIVE COVERINGS

(76) Inventor: Marie Kowalski, P.O. Box 205, Angel Fire, NM (US) 87710

( * ) Notice: Subject to any disclaimer, the term of this patent is extended or adjusted under 35 U.S.C. 154(b) by 0 days.

(21) Appl. No.: 11/765,765

(22) Filed: Jun. 20, 2007

(65) Prior Publication Data

US 2007/0298640 A1 Dec. 27, 2007

Related U.S. Application Data

(60) Provisional application No. 60/912,061, filed on Apr. 16, 2007, provisional application No. 60/815,736, filed on Jun. 21, 2006.

(51) Int. Cl.
*A47H 1/00* (2006.01)

(52) U.S. Cl. ..... 160/330; 16/87.2

(58) Field of Classification Search ..... 160/348, 160/330, 38; 24/327, 343, 349; 248/215, 248/340
See application file for complete search history.

(56) References Cited

U.S. PATENT DOCUMENTS 982,610 A * 1/1911 Knight ..... 16/87.2
2,323,444 A 7/1943 Bixer
2,496,910 A 2/1950 Fridolph
2,522,358 A * 9/1950 Perry et al. ..... 160/348
2,560,975 A * 7/1951 Metzger ..... 160/348
2,583,529 A 1/1952 Halpern
2,633,321 A * 3/1953 Coulter ..... 248/215
2,895,194 A * 7/1959 Hanson ..... 24/327
2,934,782 A 5/1960 Wootton
D194,754 S 3/1963 Maras
D354,648 S 1/1995 Wagner
5,695,161 A * 12/1997 Brozak, Jr. ..... 248/215
5,896,909 A * 4/1999 Sartini ..... 160/349.1
6,213,190 B1 * 4/2001 Hannerstig ..... 160/349.2
2005/0055799 A1 * 3/2005 Chen ..... 16/87.2

FOREIGN PATENT DOCUMENTS

JP 04215713 * 8/2002

* cited by examiner

*Primary Examiner*—Blair M. Johnson
(74) *Attorney, Agent, or Firm*—Jeffrey D. Myers; Justin R. Jackson; Peacock Myers, P.C.

(57) ABSTRACT

A decorative fabric panel system wherein one or more fabric panels are held by one or more removably positionable clip members having an openable and closable latch member. One or more hooks are preferably provided suspending the clips and fabric panels from a pre-determined location.

6 Claims, 3 Drawing Sheets

METHOD AND APPARATUS FOR PROVIDING DECORATIVE COVERINGS

CROSS-REFERENCE TO RELATED APPLICATIONS

This application claims priority to and the benefit of U.S. Provisional Patent Application Ser. No. 60/815,736, entitled "Window Fingers," filed on Jun. 21, 2006, and to U.S. Provisional Patent Application Ser. No. 60/912,061, entitled "Window Fingers," filed Apr. 16, 2007, and the specifications thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

Field of the Invention (Technical Field)

The present invention relates to decorative coverings, including but not limited to window coverings. Particularly, the present invention relates to a decorative covering system wherein panels of fabric can quickly and easily be suspended from predetermined locations.

BRIEF SUMMARY OF THE INVENTION

An embodiment of the present invention relates to a clip for carrying fabric panels having a front face and a rear face, at least one hook, having an attachment portion, attached to the rear face of the clip, and a latch member attached to the rear face of the clip, and movable from an open to a closed position to trap a portion of at least one of the fabric panels.

The clip can have first and second, spaced apart bosses attached to the rear face of the clip, and the latch member can optionally be pivotally connected to the first boss and preferably moves in a horizontal plane from an open to a closed position.

In one embodiment, the clip has an undercut portion adjacent to the second boss and the latch member has a catch portion which engages with the undercut and a release portion which disengages the catch portion from the undercut. The clip can also have a plurality of ribs attached to its rear face which extend between the bosses and which ribs are disposed at least substantially normal to the bosses. The clip preferably has two hooks, each attached to one of the bosses and which extend vertically therefrom and preferably substantially parallel therewith. The hooks can have an inverted "J" shape and an open end of the "J" shape preferably extends downward, thus defining the attachment portion.

In one embodiment, the clip also has an opening extending from its front face to its rear face and the opening is optionally centered on the front face. An ornamental decoration can optionally be positioned in and held in the opening.

An embodiment of the present invention also relates to a decorative fabric panel system for hanging on curtain rods having a clip including a front face and a rear face, at least one hook attached to the rear face of the clip, the hook having an attachment portion for attachment to the curtain rod, a latch member, attached to the rear face of the clip, and movable from an open to a closed position; and a fabric panel, held in place to the clip by the latch member. The system can also include at least two horizontally-spaced apart ribs and one vertically extending boss located at each end of the ribs. One or more decorative elements can optionally be provided which are removably positionable from the fabric panel.

An embodiment of the present invention also relates to a method for hanging a fabric panel including securing the fabric panel to a clamp by clamping the fabric panel between a plurality of spaced-apart members, and hanging the clamp and fabric panel from a predetermined location by disposing hooked members of the clamp over an interfacing surface of the predetermined location. In the method, securing the fabric panel can include securing the fabric panel between a plurality of spaced apart members with a pivotally-connected hasp-type mechanism. Further, the hooked members can be fixedly secured to the clamp and can be disposed behind a back surface of the fabric panel. A portion of the fabric panel can be displayed through an opening which is disposed through a front face of the clamp.

Objects, advantages and novel features, and further scope of applicability of the present invention will be set forth in part in the description to follow, taken in conjunction with the accompanying drawings, and in part will become apparent to those skilled in the art upon examination of the following, or may be learned by practice of the invention.

BRIEF DESCRIPTION OF THE SEVERAL VIEWS OF THE DRAWINGS

The accompanying drawings in the attachment, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention.

DETAILED DESCRIPTION OF THE INVENTION

The present invention provides another embodiment of the invention disclosed in U.S. Provisional Patent Application Ser. No. 60/815,736. The invention is further described in the documents attached hereto.

Figure 1:
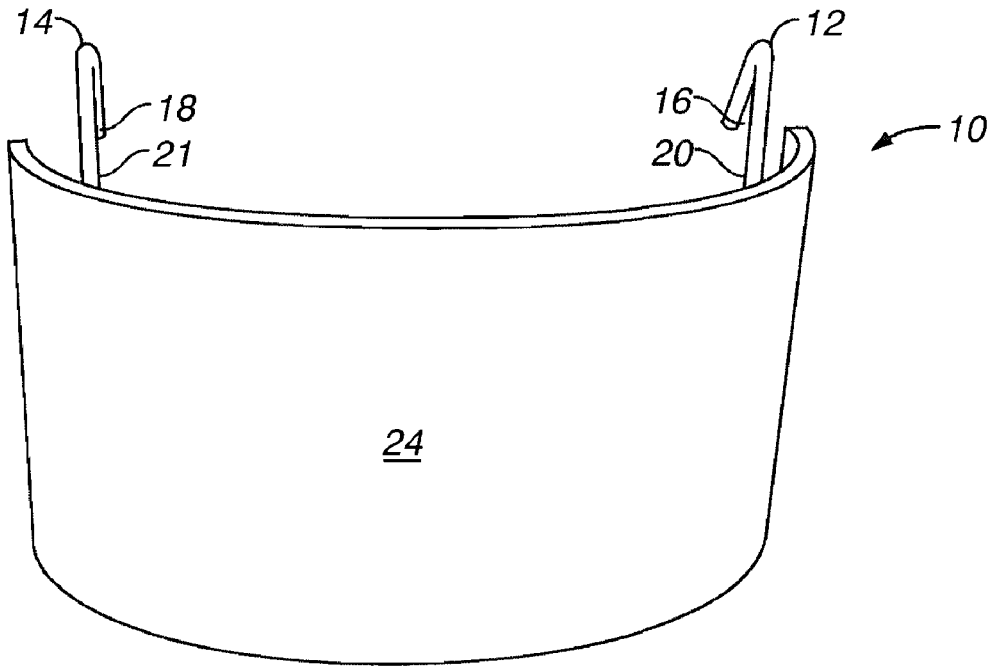
FIG. 1 is a front perspective view drawing illustrating a clip according to an embodiment of the present invention.

FIG. 1 illustrates an embodiment of the present invention wherein clip 10 is provided for hanging panels of material, preferably a fabric material, from rods, such as curtain rods, to provide a decorative system. Clip 10 preferably includes at least one hook 12 attached to a rear face of clip 10. FIG. 1, illustrates a preferred embodiment of the present invention wherein two hooks 12 and 14 are provided. The use of two hooks 12 and 14 leads to an easier connection of clip 10 to a curtain rod. Hooks 12 and 14 are both generally "J" shaped, with open or attachment portions 16 and 18 of the "J" being positioned below, when in normal use, of clip 10. Legs 20 and 22 of hooks 12 and 14 are preferably fastened to a rear face of clip 10. In FIG. 1, front face 24 of clip 10 is visible. Clip 10 is shown as being curved, which is a preferred configuration, but could be a linear surface and still function properly.

Figure 2:
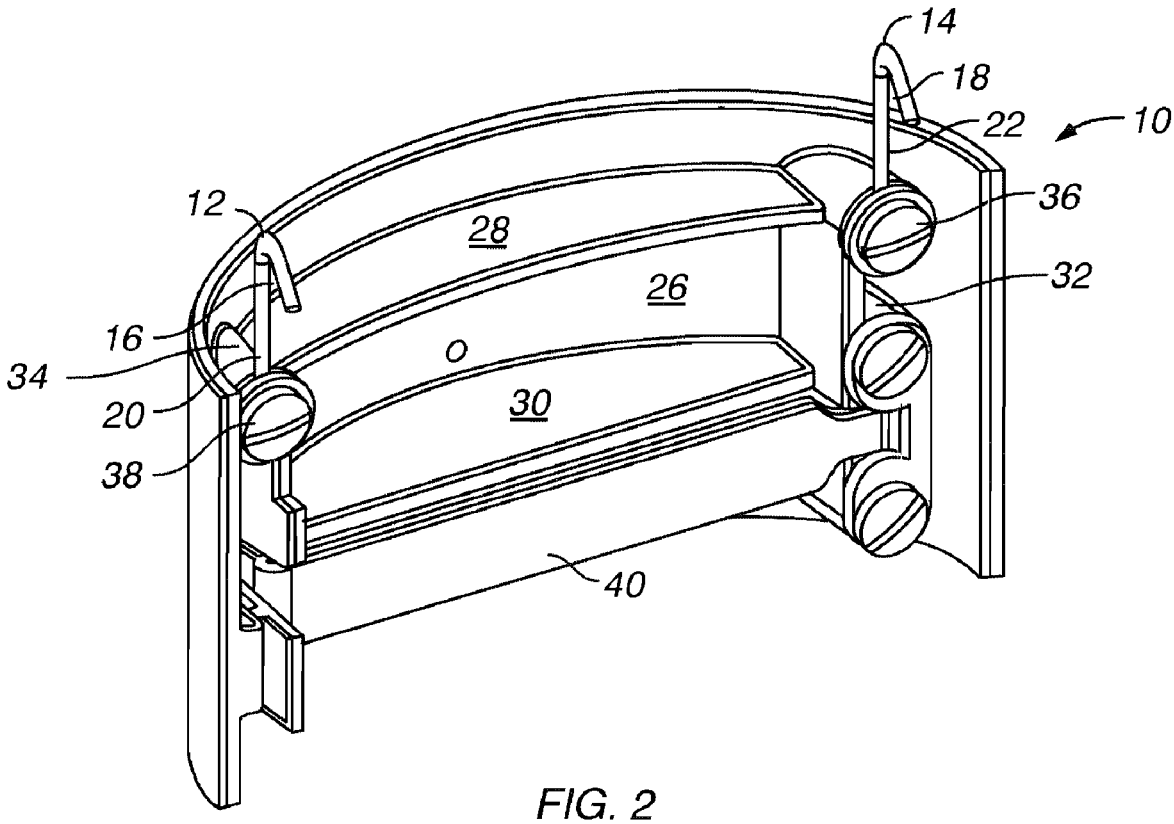
FIG. 2 is a rear perspective view drawing illustrating a clip according to an embodiment of the present invention.

FIG. 2 is a rear view of clip 10. In FIG. 2, rear face 26 of clip 10 is visible. Rear face 26 preferably has attached to it horizontal, spaced apart, ribs 28 and 30. Also preferably attached to rear face 26, at each end of the ribs 28 and 30, are vertically-spaced apart bosses 32 and 34. Legs 20 and 22 of hooks 12 and 14 are preferably attached to bosses 32 and 34 and extend upwardly therefrom. Screws, rivets, pins, bolts or another fastener or fastening method 36 and 38 preferably attach legs 20 and 22 to bosses 32 and 34 in the embodiment shown. In an alternative embodiment, legs 20 and 22 can be welded directly onto rear face 26. Bosses 32 and 34 preferably comprise latch member 40. As further illustrated in FIG. 2, latch member 40 is illustrated in a closed position.

Figure 3:
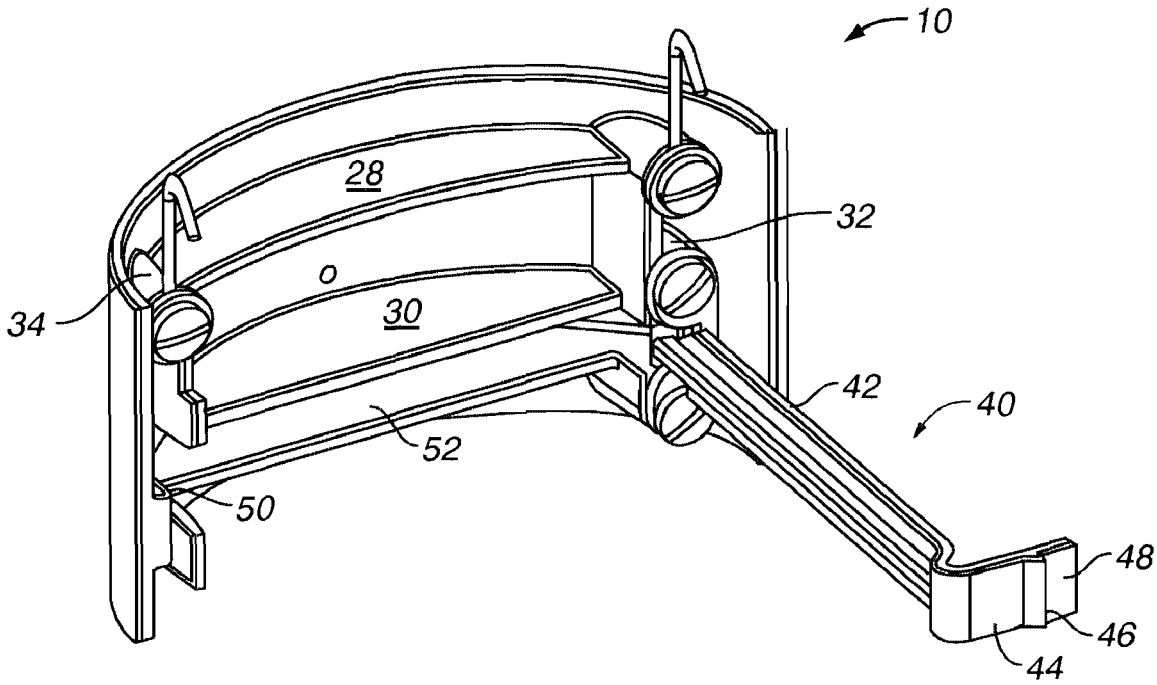
FIG. 3 is a rear perspective view drawing illustrating an embodiment of the present invention wherein a latch member is in an open position.

In FIG. 3, latch member 40 is illustrated in an open position. Latch member 40 includes pivot arm 42 pivotally attached to boss 32 and latching head 44 at an end of pivot arm 42 which is preferably opposite a pivot connection. Latching head 44 most preferably comprises catch portion 46 and release portion and/or tab 48. In one embodiment, catch portion 46 preferably cooperates with an undercut portion 50 formed adjacent boss 34. In addition, FIG. 3 further illustrates an embodiment of the present invention wherein third horizontal rib 52, positioned under and spaced from the rib 30 is provided. When latch member 40 is closed, undercut 50 preferably traps catch portion 46 and prevents latch member 40 from reopening. To open latch member 40, a user preferably moves release tab 48 to release catch portion 46 from undercut 50, thus allowing latch member 40 to pivot and move to the position illustrated in FIG. 3. Latch member 40 may be made from any resilient material, including but not limited to spring steel, rubber, a plastic material, and/or combinations thereof.

Figure 4:
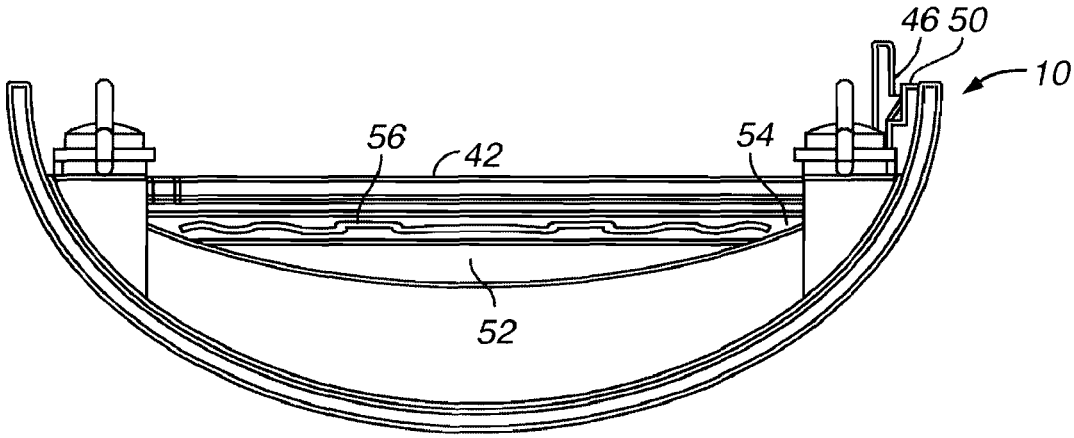
FIG. 4 is a top view drawing illustrating an embodiment of the present invention wherein a portion of a fabric panel is secured within a clip.

FIG. 4 illustrates the use of clip 10 to hold fabrics according to an embodiment of the present invention. Gap 54 is preferably formed and/or provided between pivot arm 42 and ribs 30 and 52. In this embodiment, undercut 50 preferably comprises a trap for catch portion 46. A user preferably positions fabric panel 56 within clip 10 while latch member 40 is in an open position. When latch member 40 is closed, as illustrated in FIG. 4, fabric panel 56 is preferably trapped and thus held in place. Accordingly, fabric panel 56 may be retained within clip 10 at any position along a length of fabric panel 56. In an alternative embodiment, one or more small holes, for example button holes, are provided in an upper portion of fabric panel 56. In this embodiment, the holes are preferably positioned such that hooks 12 and/or 14 of clip 10 can thus be disposed through the holes. Further, in this embodiment, one or more additional holes are also provided through which latch member 40 can be disposed, thus securing fabric panel 56 to clip 10. Further, two adjacent fabric panels 56 can be placed side-by-side and one or more holes from each panel can be placed over a single hook, 12 or 14, thus enabling the fabric panels to be joined together at an upper portion thereof.

Figure 5:
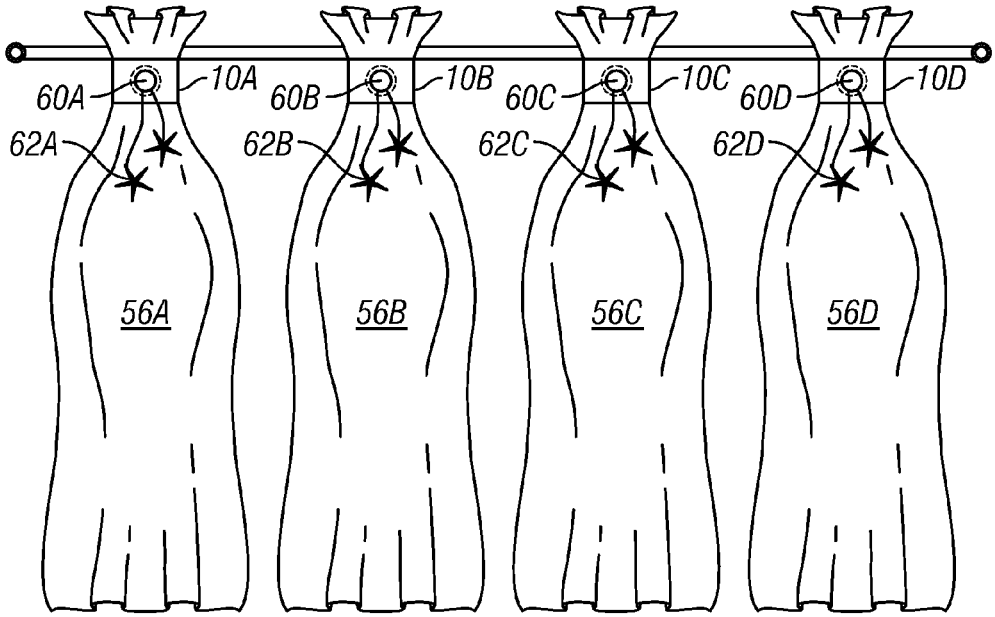
FIG. 5 is a front view drawing illustrating a decorative fabric system according to an embodiment of the present invention.

FIG. 5 illustrates clip 10 in use with fabric panel 56, thus providing a decorative fabric panel system. Clips 10 A-D are illustrated affixed to a curtain rod 58. In FIG. 5, curtain rod 58 is illustrated with a substantially round cross-section. However, as those skilled in the art will recognize upon studying this application, curtain rod 58 can also comprise a "C" cross-section or any other shape for a traverse-type rod with carrier hooks. Hooks 12 and 14 (not shown in FIG. 5) for each of clips 10 A-D are attachable to curtain rod 58. In this embodiment, open portions 16 and 18 can be disposed over curtain rod 58. Fabric panels 56 A-D are preferably carried by clips 10 A-D and are preferably held in place by latch members 40 as previously described.

In one embodiment, as illustrated in FIG. 5, opening 60 is preferably provided in one or more of clips 10 A-D. In this embodiment, openings 60 preferably extend from front face 24 to rear face 26. In one embodiment, opening 60 is preferably provided in a size and shape which allows 56 to be viewed by a user, thus providing a decorative element in itself. Alternatively, opening 60 can be provided in a size and shape which allows the attachment of one or more ornamental decorations 62 to clip 10. Each of clips 10 A-D preferably comprises a corresponding opening 60 A-D and while ornamental decorations 62 A-D are preferably provided, they are not essential. Decorations 62 A-D can be held in place in openings 60 A-D by any suitable methods, systems, and/or fasteners known to those skilled in the art. Opening 60 may be positioned anywhere on front face 24 of clip 10, but for the sake of symmetry, it is preferred that opening 60 be centered on front face 24.

Although the invention has been described in detail with particular reference to these preferred embodiments, other embodiments can achieve the same results. Variations and modifications of the present invention will be obvious to those skilled in the art and it is intended to cover all such modifications and equivalents. The entire disclosures of all references, applications, patents, and publications cited above and/or in the attachments, and of the corresponding application(s), are hereby incorporated by reference.

What is claimed is:

1. A clip carrying fabric panels comprising;

a front face and a rear face;

at least one hook attached to said rear face of said clip, said hook comprising an attachment portion; and a latch member pivotally attached to said rear face of said clip and movable from an open to a closed position and trapping a portion of a fabric panel between said rear face and said latch member; wherein said hook remains open after attachment of said fabric panel; first and second spaced apart bosses extending from said rear face of said clip, said latch member and said hook are connected to said first boss and said latch member moves in a horizontal plane from an open to a closed position;

and an opening extending from said front face to said rear face.

2. The clip of claim 1 further comprising an undercut portion, adjacent second said boss and wherein said latch member includes a catch portion for engagement with said undercut and a release portion to disengage said catch portion from said undercut.

3. The clip of claim 1 further comprising a plurality of ribs attached to said rear face and extending between said bosses, said ribs disposed at least substantially normal to said bosses.

4. The clip of claim 1 comprising two hooks, each said hook attached to one of said bosses and extending vertically therefrom.

5. The clip of claim 4 wherein said hooks comprise an inverted "J" shape with an open end of said "J" shape extending downward and defining said attachment portion.

6. The clip of claim 1 wherein said opening is centered on said front face.

* * * * *